United States Patent [19]

Rigden

[11] 4,027,795

[45] June 7, 1977

[54] DISPENSER PACK FOR CONTINUOUS STATIONERY

[75] Inventor: Peter Charles Edwin Rigden, Horsham, England

[73] Assignee: Spicers Limited, Sussex, England

[22] Filed: Jan. 12, 1976

[21] Appl. No.: 648,205

[30] Foreign Application Priority Data

Jan. 13, 1975 United Kingdom ..... 1281/75

[52] U.S. Cl. ..... 206/409

[51] Int. Cl.[2] ..... B65D 85/67

[58] Field of Search ..... 206/409, 408, 407, 395, 206/397, 389; 225/41, 17; 242/55.53, 55.3, 55.2; 197/133

[56] References Cited

UNITED STATES PATENTS

| | | | |
|---|---|---|---|
| 1,194,618 | 8/1916 | Gottschalk | 206/215 |
| 2,080,986 | 5/1937 | Pierce | 206/408 |
| 2,237,920 | 4/1941 | Armitt | 242/55.53 |
| 3,134,525 | 5/1964 | Holcombe | 206/408 |
| 3,302,781 | 2/1967 | Rudnick | 206/408 |

*Primary Examiner*—William T. Dixson, Jr.
*Attorney, Agent, or Firm*—Wolf, Greenfield & Sacks

[57] ABSTRACT

A dispenser pack for continuous stationery in roll form for use in business machines, particularly teleprinters, which serves as a carton for transit purposes and, without alteration, as a magazine or holder for the rolls for use on the business machine. It comprises a closed rectangular container, a trough shaped carrier disposed in the container, one or more rolls of stationery supported by the carrier in the container and a slot in a wall of the container through which the web of stationery on the roll is passed from the container to the platen of the machine.

12 Claims, 4 Drawing Figures

DISPENSER PACK FOR CONTINUOUS STATIONERY

BACKGROUND OF THE INVENTION

This invention relates to a dispenser pack for continuous stationery in roll form for use in business machines, for example typewriters, teleprinters or the like. Whilst the dispenser pack of the invention may be used in any such machines employing rolls of paper or like material in web form, for the sake of brevity reference will hereinafter be made solely by way of example to teleprinters and paper rolls used therein.

Conventionally, paper rolls for use in teleprinters are supplied by the paper manufacturer to the user in cartons containing a number of such rolls which after unpacking are inserted in required quantity into a roll holder or magazine forming part of the teleprinter. The work of carefully packaging the paper rolls for dispatch, unwrapping the parcel by the user and mounting of the rolls in the roll holder of the machine is time consuming and greatly increases the operational costs of the user. Moreover, due to the weight of teleprinter rolls it is essential when packing rolls for transport to use heavy duty cartons in order to avoid damage to the rolls in transit. This adds to the cost of the product.

The invention aims at obviating the foregoing disadvantages by providing a dispenser pack for the rolls which serves not only as a carton for the transit of the rolls from the factory to the user but also, without alteration, as a holder or magazine for the rolls for immediate use on the teleprinter or other business machines, thus simplifying and facilitating storage and use of the rolls.

SUMMARY OF THE INVENTION

To this end the present invention consists in a dispenser pack for continuous stationery in roll form, comprising a closed rectangular container, a rectangular substantially trough-shaped carrier disposed in said container and rotatably supporting at least one roll of said stationery between side walls of the carrier which extend parallel respectively to two opposite side walls of the container, a third side wall of the container having a slot for passing therethrough the web of stationery from the interior of the container. Advantageously, the container is provided with a viewing aperture formed in one of said two opposite side walls adjacent the mounting of the roll in the carrier, and the side wall of the carrier which extends parallel to and adjacent the side wall of the container formed with the viewing aperture is formed with a corresponding aperture which registers with the first-mentioned viewing aperture. Conveniently, the roll is supported in the carrier by means of two journals fixed in the side walls of the carrier.

Preferably, the container and the roll carrier are each formed from a flat, foldable blank of sheet material which may be laminated cardboard comprising two flat outer layers with a corrugated layer sandwiched therebetween.

BRIEF DESCRIPTION OF DRAWINGS

In order that the invention may be more readily understood, reference is made to the accompanying drawings which illustrate diagrammatically and by way of example one embodiment thereof, and in which.

DETAILED DESCRIPTION OF PREFERRED EMBODIMENT

Figure 3:
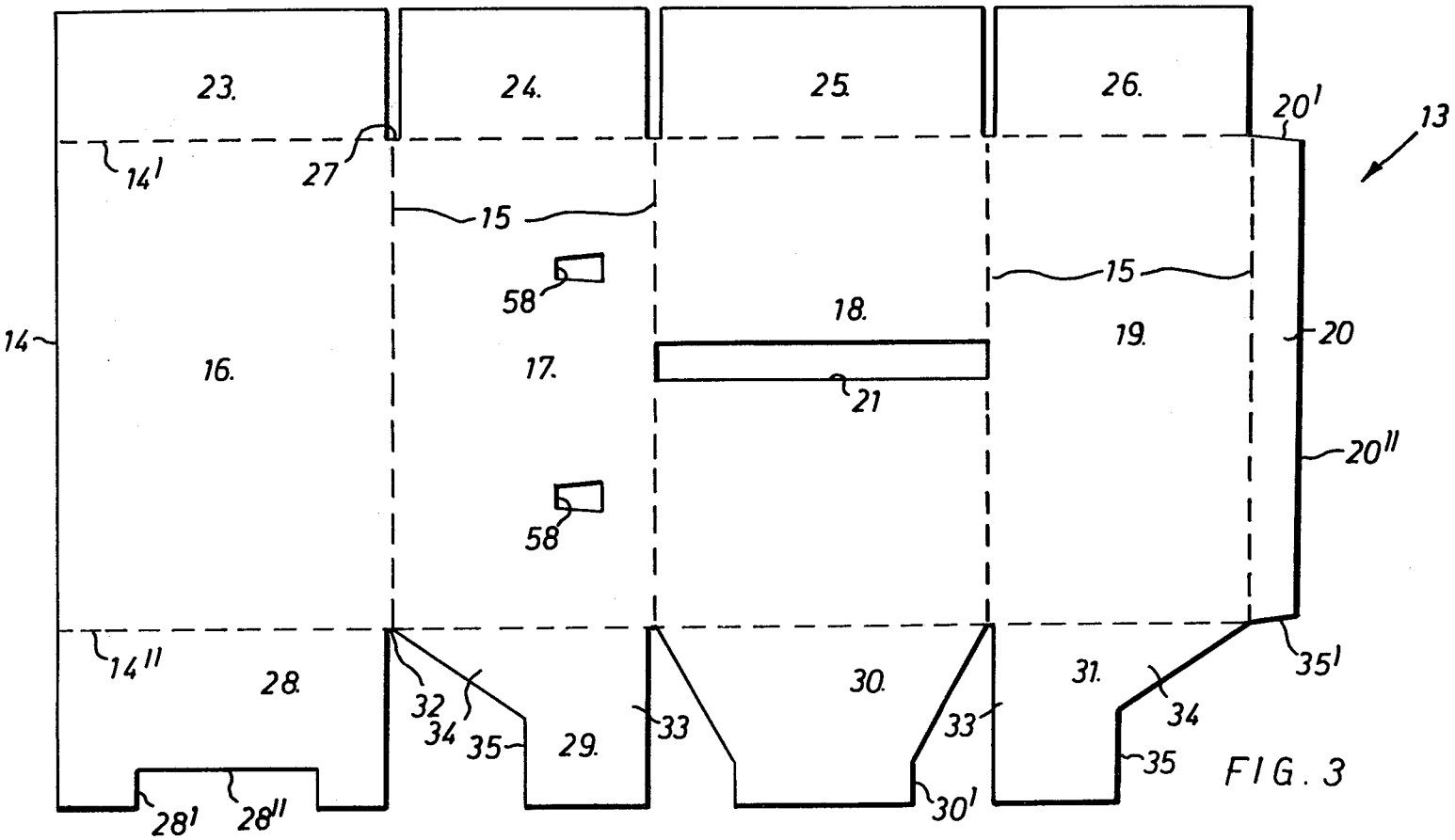
Figure 4:
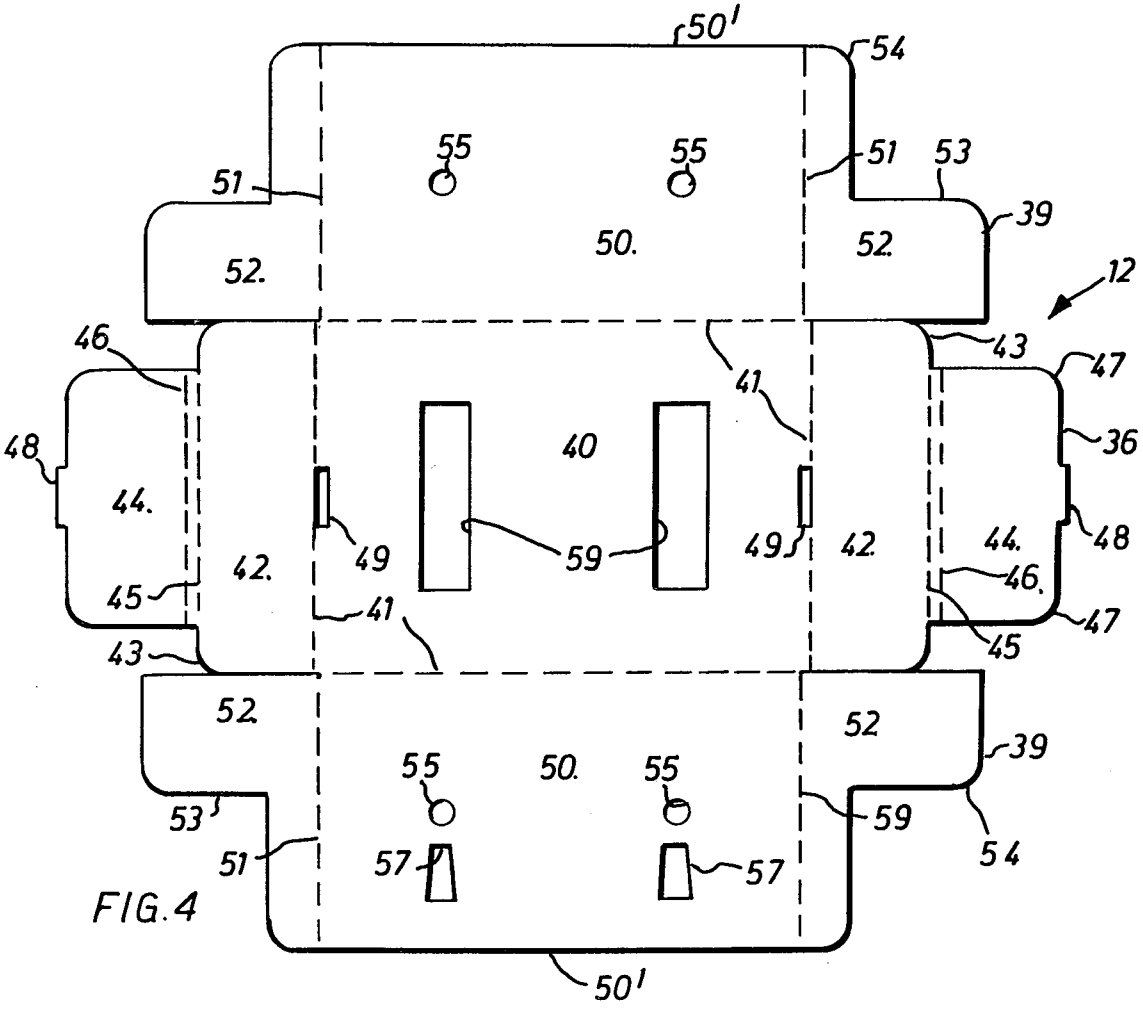

Referring to the drawings, the dispenser pack comprises a closed rectangular container 1 and a rectangular substantially trough-shaped carrier 2 disposed in the container 1 and rotatably supporting two rolls of stationery 3 between the two side walls 4 and 5 of the carrier 2. The container 1 has four side walls 6, 7, 8, 9 and a top 10 and bottom 11. The carrier 2 with the rolls of stationery 3 is slidably inserted into the container 1 trough the top 10 prior to closure of the container so that the two side walls 4 and 5 of the carrier respectively extend parallel and adjacent to the two opposite side walls 7 and 9 of the container 1. The carrier 2 and the container 1 are respectively formed from foldable blanks 12 and 13 (FIGS. 4 and 3) of sheet material, for example laminated cardboard having two flat outer layers with a corrugated layer sandwiched therebetween.

Figure 1:
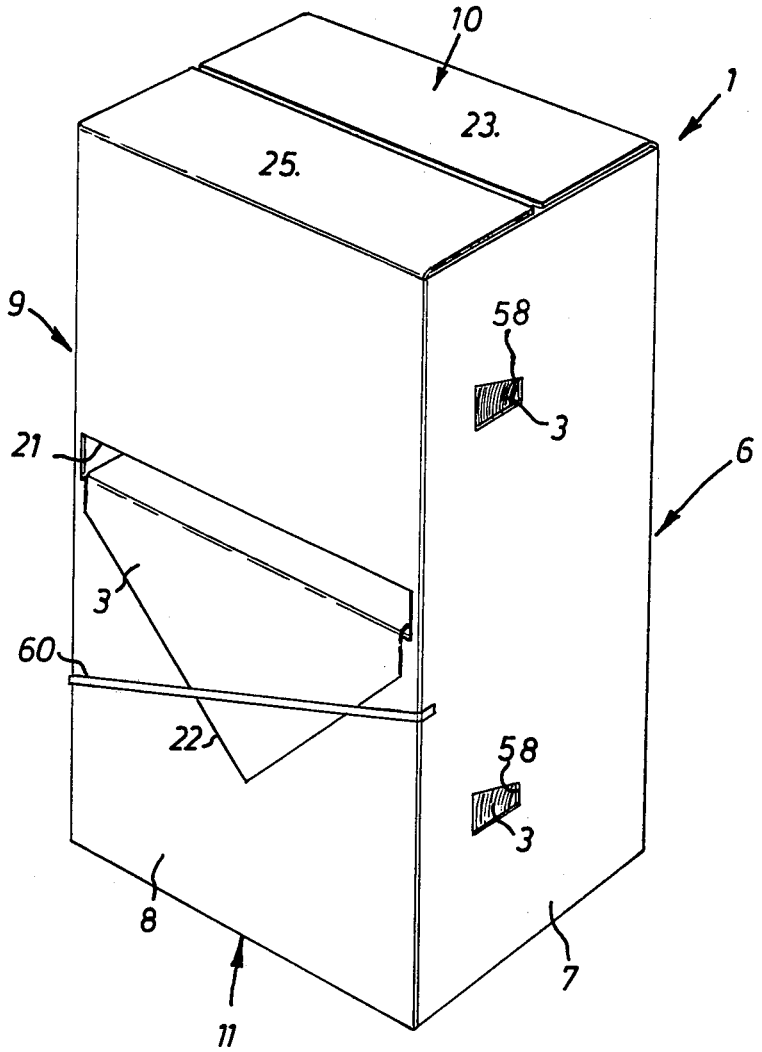
FIG. 1 is a perspective view of a dispenser pack with two rolls of stationery.

The container blank 13 comprises an elongate middle portion 14 from which are formed the four rectangular side walls 6, 7, 8, 9 of the container 1 and a contiguous overlapping side wall portion (more particularly referred to hereinbelow) which is of smaller width than the container side walls and which is provided in order to avoid a corner joint between two adjacent side walls of the container. To facilitate folding of the blank 13 to form the container 1, the blank is provided with appropriate fold or score lines. In the case of the middle portion 14 four such fold lines 15 are provided which extend parallel to the transverse edges of the middle portion 14 and which laterally define four contiguous side wall panels 16, 17, 18, 19 and an overlapping side wall panel 20 which tapers slightly at 20' towards its free transverse edge 20 . It is, of course, possible to dispense with the overlapping side wall panel 20 if a satisfactory corner joint can be provided instead. The side wall panel 18 constitutes in the erected condition of the container 1 the front wall thereof and has an elongate rectangular aperture 21 for passing therethrough the leading edge or edges 22 (see FIG. 1) of the web or webs of stationery material 3, which is supported in roll form within the container 1 by means of the trough-shaped carrier 2, more particularly referred to hereinbelow.

Extending parallel to one longitudinal side 14' of the middle portion 14 of the container blank 13 and contiguous with the four rectangular panels 16 to 19 forming the side walls of the container 1, are four shorter rectangular panels 23, 24, 25, 26 which are separated from each other by a small spacing 27 in the zones of the three fold lines 15 extending between the side wall panels 16, 17, 18 and 19. These shorter rectangular panels 23 to 26 are adapted to form the top 10 of the container 1 when folded along the longitudinal side 14' of the middle portion 14 and secured together by adhesive.

Along the other longitudinal side 14'' of the middle portion 14 of the container blank 13 and contiguous with the four panels 16 to 19 forming the side walls of the container, there extend four further shorter panels 28, 29, 30, 31 which are separated from each other by a spacing 32 in the zones of the three fold lines 15 extending between the side wall panels 16 to 19. These four further shorter panels 28 to 31 are respectively so shaped that when folded along the other longitudinal side 14'' of the middle portion 14 of the container blank 13 in a predetermined sequence they interengage one another to form the bottom 11 of the container 1' which is made sufficiently rigid without the use of additional securing means such as adhesive. More particularly, the panel 30 tapers outwardly along the greater part of its length and terminates in a narrow rectangular tongue portion 30'. The panel 28 contiguous with the side wall panel 16 constituting the rear wall 6 of the container 1, is rectangular and provided at its outer free edge with a centrally disposed rectangular cut-out 28' the dimensions of which substantially correspond to those of the rectangular tongue 30'. The two shorter panels 29, 31 are arranged in mirror-image symmetry, laterally of the panel 30 and comprise an elongate rectangular portion 33, disposed adjacent the shorter panel 30 and a right-angle triangular portion 34 the two sides of which respectively adjoin the elongate rectangular portion 33 and the adjacent middle portion 14 of the blank 13. To produce a rigid bottom from the four shaped shorter panels 28 to 31, these panels are folded over one another during the erection of the container in the following sequence: first folded over is the panel 28; next the two symmetrical panels 21 and 31 are folded over the panel 28 whereby a slit is formed which is defined by the longitudinal edge 28'' of the cut-out 28' and the edge portions 35, which are adjacent the triangular portions 34, of the two symmetrical panels 29 and 31; and finally the panel 30 having the tongue 30' is folded over the two symmetrical panels 29, 31 and pressed inwardly thereagainst until the tongue 30' snaps into said slit, whereupon when the pressure is released a substantially flat bottom is formed which is sufficiently rigid to resist outwardly directed pressure due to the dead weight of the carrier 2 and rolls 3.

The blank 12 of the trought-shaped roll carrier 2 comprises an elongate middle portion 36, from which are formed the base 37 of the trough and two comparatively low end walls 38 thereof, and two slightly shorter elongate portions 39 of identical shape, which adjoin the longitudinal sides of the middle portion 36 and from which are formed the side walls 4 and 5 of the trough. A rectangular panel 40 defined by fold lines 41 constitutes the base 37 of the trough, and is adjoined at each of its two transverse sides by a first rectangular panel 42 of the same width as the base panel 40 but of smaller longitudinal extension. The free outer corners 43 of these two shorter panels 42 are provided with a radius. Contiguous with each panel 42 is a further rectangular panel 44 which is slightly longer but of smaller width than the panel 42. A first fold line 45 delineates these two adjacent panels 42, 44 and a further fold line 46 is provided in the narrower panel 44 parallel to the first fold line 45 and spaced therefrom by a distance substantially corresponding to double the thickness of the blank material. The free outer corners 47 of each rectangular panel 44 are also provided with a radius and a short, narrow tab 48 is formed centrally at the free end edge of each panel 44, the tab 48 being engageable, upon erection of the carrier 2, in a rectangular slot 49 formed in the base panel 40 adjacent its transverse fold line.

Each of the two shorter elongate portions 39 which adjoin the longitudinal sides of the middle portion 36 of the carrier blank 12, comprises a rectangular panel 50 which is contiguous with the panel 40 forming the base 37 of the trough and which is of substantially the same length as but of slightly smaller width than the base panel 40. Each rectangular panel 50 is defined by the longitudinal fold line 41 of the rectangular panel 40, two spaced apart transverse fold lines 51 and a free outer longitudinal edge 50'. Contiguous with each transverse fold line 57 is a rectangular panel 52 which in the zone of the free outer corner has a right-angled cut-out 53 the outer corners 54 of which are provided with a radius. The length of each side of the right-angled cut-out 53 corresponds substantially to half the width of the elongate portion 39.

Figure 2:
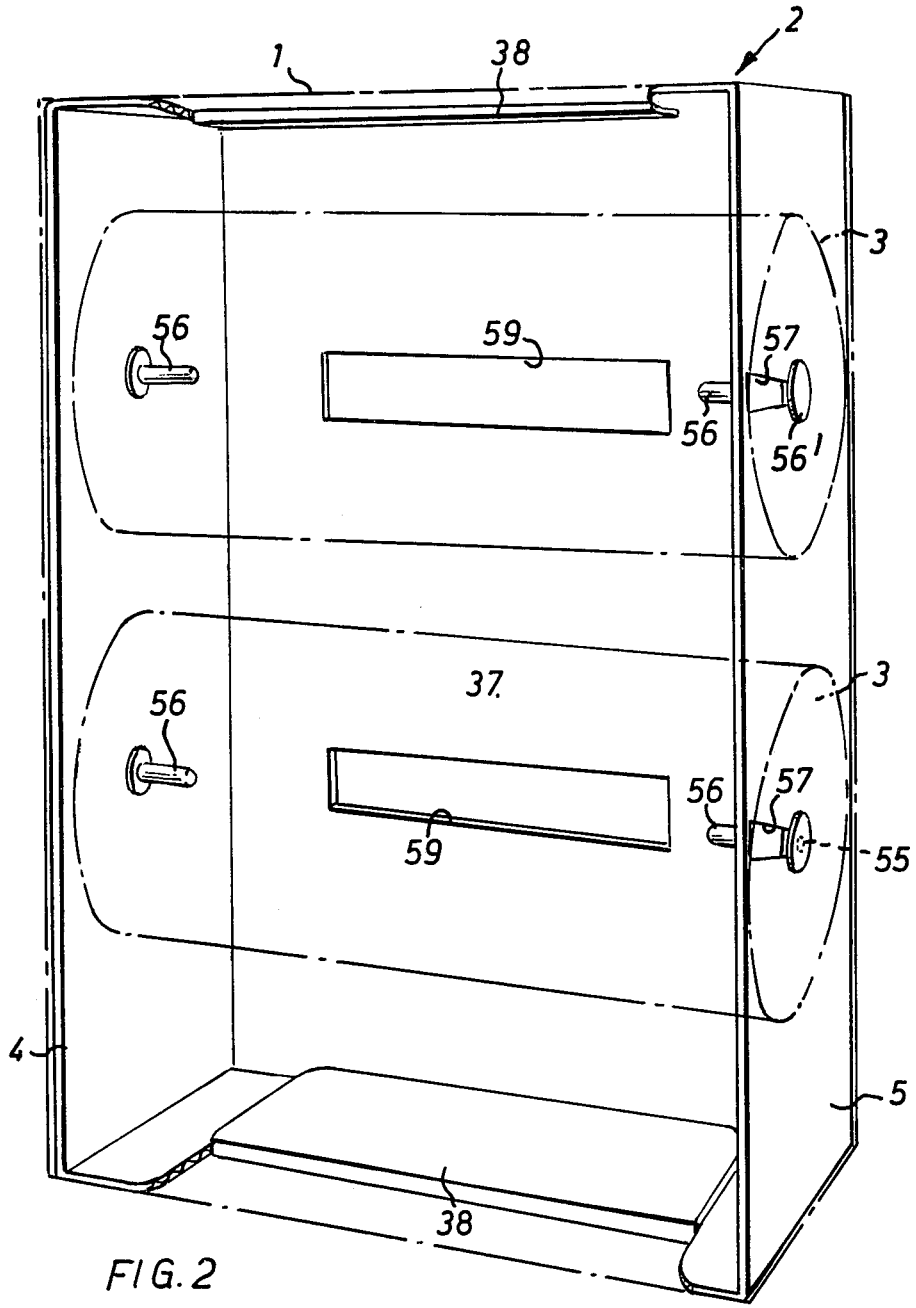
FIG. 2 is an enlarged perspective view of a roll carrier for the dispenser pack of FIG. 1, and FIGS. 3 and 4 respectively show the blanks for producing the container and the roll carrier of the pack.

The rectangular panel 50 of each of the shorter elongate portion 39 is provided on its longitudinal centre line with two spaced apart circular apertures 55 each of which is adapted to receive a flanged journal 56 (FIG. 2), for example of plastics material, for rotatably supporting a roll 3 of stationery inserted into the carrier 2 upon erection thereof. Furthermore, one of the rectangular panels 50 is provided with a transversely extending elongate slot 57 adjacent each circular aperture 55, the slots 57 constituting apertures for viewing the dispensing progress of the stationery within the carrier 2. Similar viewing apertures 58 (FIG. 3) are provided in the side wall panel 17 of the container blank 13, which apertures are in register with the slots 57 in the carrier 2 in the assembled condition of the dispenser pack.

The roll carrier 2 is erected by folding the various panels of the blank 12 along the fold lines in a predetermined sequence without the use of any additional securing means, such as adhesive or staples. First the two shorter elongate portions 39 are folded over towards the middle portion 36 so that they extend at right-angles to the portion 36. Next the outer panels 52 of each of the shorter elongate portion 39 are folded inwardly until they extend at right-angles to the contiguous rectangular panel 50 and thus also to the adjacent as yet unfolded, middle portion 36 of the blank 12. This folding brings the respective two adjacent outer panels 52 into one plane with the adjacent edges thereof in butting relationship. Then the two end panels, each made up of the two shorter rectangular panels 42, 44, of the elongate middle portion 36 are folded over the adjacent fold line 41 and on to the respective two end panels 52, and thereupon the outer narrower rectangular panel 44 is folded along the first fold line 45 inwardly over the edges of the panels 52 having the right-angle cut-out 53 and doubled up along the further fold line 46 onto the inner surfaces of the end panels 52. In order to secure the outer narrower panel 44 and thus the wall formation produced, the tab 48 is pushed into the rectangular slot 49 in the rectangular panel 40 forming the base 37 of the trough.

Upon completion of the erection of the carrier 2, the two rolls 3 are individually mounted within the carrier 2 by being axially aligned with the two oppositely disposed circular apertures 55 in the side walls 4, 5 of the trough and receiving in the aligned position the two plastics journals 56 which are inserted through the circular aperture 55 and which are secured to the outer surfaces of the side walls 4, 5 by adhesive via their respective flanges 56'. In order to facilitate handling of the individual rolls 3 during alignment and mounting thereof, two elongate rectangular apertures 59, sufficiently large to receive a hand of an operator, are provided in the base 37 of the carrier 2 in horizontal alignment with each two opposite circular apertures 55.

With the rolls 3 of stationery mounted on the carrier 2, the latter is slidably inserted into the container 1 through the still open top 10 formed by the four rectangular panels 23 to 26, and so that the open side of the trough is adjacent the front wall 8 of the container provided with the dispensing slot 21. Thereupon each two opposite panels 23, 25 and 24, 26 of the top 10 of the container are folded inwardly and the top two panels 23, 25 secured by adhesive to those therebeneath to form a substantially rigid top. The length of the trough-shaped carrier 2 corresponds substantially to the height of the container 1.

Whilst in the embodiment described the carrier accommodates two rolls of stationery, it will be appreciated that more than two such rolls may be thus accommodated, or if desired only one such roll. Advantageously, each roll of stationery is supported on a tube (not shown) of cardboard or plastics. Each end of the tube may receive with a force fit an annular bearing member of plastics for the journals, which member conveniently comprises a cylindrical portion and an inwardly extending radial end flange provided with an aperture for rotatably receiving the journals. In an alternative construction the cylindrical portion may be provided at each end with a flange.

In order to prevent the leading end of the web or webs of stationery retracting into the dispenser during transit, the end or ends are affixed to the outside of the dispenser, for example, by a length of self-adhesive tape 60.

When the dispenser is required for use, it is positioned in alignment with the plattern of the teleprinter, the end or ends of the rolls are detached from the dispenser and are passed around the platten of the machine and are immediately ready for use. Generally speaking, the weight of the rolls in the pack is sufficient to permit the pack to be free-standing behind the teleprinter. However, if necessary, there may be supplied to the user a base board for the teleprinter having a shallow rectangular shaped open topped box, dimensioned to receive the pack, into which the pack can be placed to hold it firmly in position, during use, with respect to the teleprinter.

I claim:

1. A dispenser pack for continuous dispensing of stationery in web form from a roll thereof comprising:
- a closed rectangular container having a top, a bottom, a front wall, a rear wall and a pair of side walls,
- a rectangular carrier having a rear wall, a pair of side walls and top and bottom walls, said carrier being open at its front, said carrier being disposed in the container
- said side walls of the carrier including means for rotatably supporting at least one roll of said stationery between the side walls of the carrier,
- the front wall of the container having a transversely extending slot formed therein to permit the web of stationery to pass therethrough from the interior of the container, said transversely extending slot being located on the front wall between the top and bottom of the front wall.

2. A dispenser as defined in claim 1 further comprising:
- means defining a viewing aperture in the adjacent side walls of each of the container and the carrier at a location adjacent said means for mounting said roll of stationery,
- said viewing apertures in said adjacent container and carrier side walls being in registry with each other.

3. A dispenser pack as defined in claim 1, wherein the roll is supported in the carrier by means of two journals fixed in the side walls of the carrier.

4. A dispenser as defined in claim 1 further comprising:
- said rear wall of the carrier being formed to define a transversely extending slot disposed adjacent the location of the means for mounting each of said stationery rolls, thereby to facilitate handling of each roll during mounting thereof in the carrier.

5. A dispenser pack as claimed in claim 1, wherein the container and the roll carrier are each formed from a flat, foldable blank of sheet material.

6. A dispenser pack as claimed in claim 5, wherein the sheet material is laminated cardboard comprising two flat outer layers with a corrugated layer sandwiched therebetween.

7. A dispenser pack as defined in claim 1 further comprising:
- said carrier further including means for rotatably supporting a plurality of said rolls substantially parallel to each other; and
- a transversely extending slot in the rear wall of the carrier and associated with each of the means for supporting said rolls to facilitate mounting of the rolls in the carrier.

8. A dispenser pack as defined in claim 7 further comprising:
- the adjacent side walls of each of the container and carrier each having viewing apertures formed therein, said apertures being disposed in proximity to each of the means for mounting the stationery rolls and being in registry with each other when the carrier is disposed within the container.

9. A dispenser pack as defined in claim 7 further comprising:
- said transversely extending slot in the front wall of the container being disposed at a heightwise location which is intermediate the uppermost and lowermost of said roll supporting means of said carrier.

10. A dispenser pack as defined in claim 1 further comprising:
- said carrier being insertable into the container through an end of the container.

11. A pair of blanks formed from corrugated cardboard for assembly into a dispenser pack for dispensing stationery in roll form, one of said blanks comprising a container blank and the other of said blanks comprising a carrier blank, and further comprising:
- said container blank including, in serial connection, a rear panel, a first side panel, a front panel and a second side panel, each of said panels having end flaps extending from their opposite ends and a transversely extending dispensing slot formed between the ends of the front panel said container blank being formable into an end-loadable container;
- said carrier blank comprising:
- a rectangular central panel;
- a pair of side wall panels extending from the sides of the central panel;
- a pair of end panels extending from the ends of the central panel;
- a panel extension connected to and extending from each of the end panels, said panel extension being of narrower width than the central panel, each of the extensions having a tab extending outwardly from its outer edge;

each of the ends of the carrier side wall panels having an L-shaped flap extending from its ends, said L-shaped flap including a tongue;

said carrier blank being foldable into a carrier configuration having a rear wall, a pair of side wall and top and bottom end walls and having an open front;

means formed in each of the carrier sidewall panels for rotatably supporting at least one roll of stationery therebetween when said carrier is assembled;

at least one transverse slot in the central panel to facilitate mounting of a stationery roll when the blank is assembled to its carrier configuration;

said carrier being insertable through an open end of the container formed from the container blank.

12. An arrangement as defined in claim 11 wherein the carrier blank includes a plurality of said means for supporting a plurality of said rolls and further comprising:

said central panel of the carrier blank having a corresponding plurality of said transverse slots.

* * * * *